United States Patent [19]

Matsumoto

[11] Patent Number: 4,511,087

[45] Date of Patent: Apr. 16, 1985

[54] AIR MIST NOZZLE APPARATUS

[75] Inventor: Kozo Matsumoto, Nishinomiya, Japan

[73] Assignee: Kyoritsu Gokin Mfg. Co., Ltd., Hyogo, Japan

[21] Appl. No.: 482,034

[22] Filed: Apr. 4, 1983

[30] Foreign Application Priority Data

Apr. 8, 1982 [JP] Japan ..... 57-51500[U]

[51] Int. Cl.[3] ..... B05B 7/06

[52] U.S. Cl. ..... 239/433; 239/430

[58] Field of Search ..... 239/430, 433

[56] References Cited

U.S. PATENT DOCUMENTS

| | | | |
|---|---|---|---|
| 1,691,048 | 11/1928 | De Kermor | 239/430 |
| 2,764,455 | 9/1956 | Seibel | 239/430 |
| 3,587,974 | 6/1971 | Rosenkranz et al. | 239/433 |

*Primary Examiner*—Andres Kashnikow
*Assistant Examiner*—James R. Moon, Jr.
*Attorney, Agent, or Firm*—Claude A. Patalidis

[57] ABSTRACT

There is disclosed a nozzle apparatus for spraying a mixture of gas and liquid. The apparatus comprises a casing having therein a gas jetting nozzle member and a liquid chamber. The liquid flows out of the chamber in directions to cross at a predetermined angle with a direction in which the gas is jetted out of the nozzle member.

4 Claims, 16 Drawing Figures

AIR MIST NOZZLE APPARATUS

BACKGROUND OF THE INVENTION (1) Field of the Invention

This invention relates to air mist nozzle apparatus used, for example, for spraying cooling water on to steel materials produced by a continuous casting system or for spraying liquid preparations on to crops in kitchen gardens or orchards.

(2) Description of the Prior Art

Spray nozzle apparatus employ a method of atomizing liquid either by pressurizing it or by mixing it with air. The former method produces linear cross-sectional spray patterns, or thin water screens where the liquid is water. Therefore, when spraying water on to hot steel plate, for example, water will hit the plate in linear forms and its cooling efficiency is low. Furthermore, this method cannot make effective use of evaporation heat in that it cannot produce fine water particles which would readily evaporate upon contact with the hot plate. Large particles of water tend to rebound from the plate and therefore stay in contact with the plate only for a very short time, which does not produce a good cooling effect.

On the other hand, the latter method atomizes liquid well and produces oval cross-sectional spray patterns which have large areas of contact with the steel plate thereby producing a good cooling effect. Water is sprayed in fine particles according to this method, which will readily evaporate upon contact with the plate, and therefore efficient cooling may be carried out with a small amount of water. Fine particles of water will not rebound from the plate, but the spraying air will flow almost along the plate surface to help to maintain the sprayed water in contact with the steel plate for a long time, thereby to produce a good cooling effect. It is known that in the case of spraying liquid preparation the better the atomization, the better is the insect killing rate.

As will be understood from the above, it is an accepted fact that the method of atomizing liquid through mixture with gas is the better suited than the other for cooling steel plates and for spraying liquid preparations.

Nozzle apparatus of the air mist type are in wide use in recent times. They include, for example, a nozzle apparatus as disclosed in the Federal Republic of Germany Pat. No. 2,816,441, which is described now with reference to FIG. 13 of the accompanying drawings.

This apparatus comprises a jet pipe 102 connected to a nozzle tip 101 defining an air mist spraying orifice 101' at an end thereof. The jet pipe 102 contains a liquid supply pipe 103 fixed coaxially thereto to jet out liquid toward the orifice 101'. A gas supply pipe 106 is connected to a base end portion of the jet pipe 102 to jet out gas into a tubular space 105 defined between the jet pipe 102 and the liquid supply pipe 103 and communicating with a gas/liquid mixing space 104 in the jet pipe 102.

The nozzle apparatus of this air mist type has a disadvantage that the spray hardly diverges from an axis corresponding to the center of the nozzle tip in a symmetrical manner. This is because the gas is not under even pressure around the liquid supply pipe 103 when mixing with the liquid leaving the pipe 103. Therefore, to obtain a substantially uniform gas pressure around the end of the liquid supply pipe 103, the apparatus has a long distance from the gas supply pipe 106 to where the gas and liquid mix with each other, or the forward end of the liquid supply pipe 103.

However, such a solution requires a long double pipe portion formed of the jet pipe 102 and the liquid supply pipe 103. More particularly, since the tubular space 105 has a uniform area in the axial direction which presents no throttling action, it is necessary to insert a maximum length of the liquid supply pipe 103 in the jet pipe 102 in order to obtain a uniform peripheral pressure of the gas jetted from the tubular space 105 into the gas/liquid mxing space 104. Furthermore, the gas/liquid mixing space must have a great axial length in order to atomize the liquid positively because the liquid and gas are delivered to the gas/liquid mixing space in parallel streams. The entire nozzle apparatus therefore has to be large size and is limited in application by reason of requiring a large installation space. Moreover, since a considerable length of the liquid supply pipe 103 has to be inserted as described, a high technical level and a high degree of precision are required for aligning the forward end of the liuqid supply pipe 103 and the air mist jet pipe 102. This, together with the large size of the entire apparatus, tends to raise the manufacturing cost.

FIG. 14 shows results of tests carried out on the described nozzle apparatus of double pipe construction in respect of spray divergence. The results show that its spray patterns are not symmetric about the center of the nozzle tip.

SUMMARY OF THE INVENTION

The object of this invention is to provide an improved nozzle apparatus of the air mist type as described above, which has a compact construction, is capable of atomizing liquid well, and produces a spray divergence symmetric about the center of the nozzle tip.

A nozzle apparatus according to this invention comprises a jet pipe having a nozzle tip at one end thereof, a casing connected to the other end of the jet pipe and including a liquid supply port, and a nozzle member disposed in the casing to inject gas, wherein the nozzle member and the casing define a chamber in communication with the liquid supply port and a liquid outflow passage means extending from the chamber, the liquid outflow passage means having outflow directions crossing at a predetermined angle with a direction in which the gas is jetted out at a position adjacent a gas injection mouth of the nozzle member.

The chamber as now provided creates a substantially uniform pressure peripherally of the liquid outflow passage, which results in a spray divergence symmetric about the nozzle tip. By employing the new chamber structure to carry out atomization, the nozzle apparatus of this invention is much more compact than the prior art apparatus. Because of the compactness, the apparatus may readily be installed, for example, between rollers of a continuous casting system in which only small installation spacing is allowed. Liquid is reduced to fine and even particles since the liquid outflow passage has outflow directions crossing adjacent the gas injection mouth, and the spray diverges to be substantially symmetric about the nozzle tip as described. This has the advantages of leaving almost no cooling stain on steel plates and of high cooling efficiency.

When used for spraying a liquid preparation, the nozzle apparatus of this invention is effective to reduce a certain amount of liquid preparation to fine particles and spray them substantially evenly over a certain area.

Other advantages of the present invention will be apparent from the following description.

BRIEF DESCRIPTION OF THE DRAWINGS

FIG. 2 is a sectional view taken on line II—II of FIG. 1, FIGS. 3 through 5 show a modified nozzle apparatus, in which

DETAILED DESCRIPTION OF THE PREFERRED EMBODIMENTS

Figure 1:
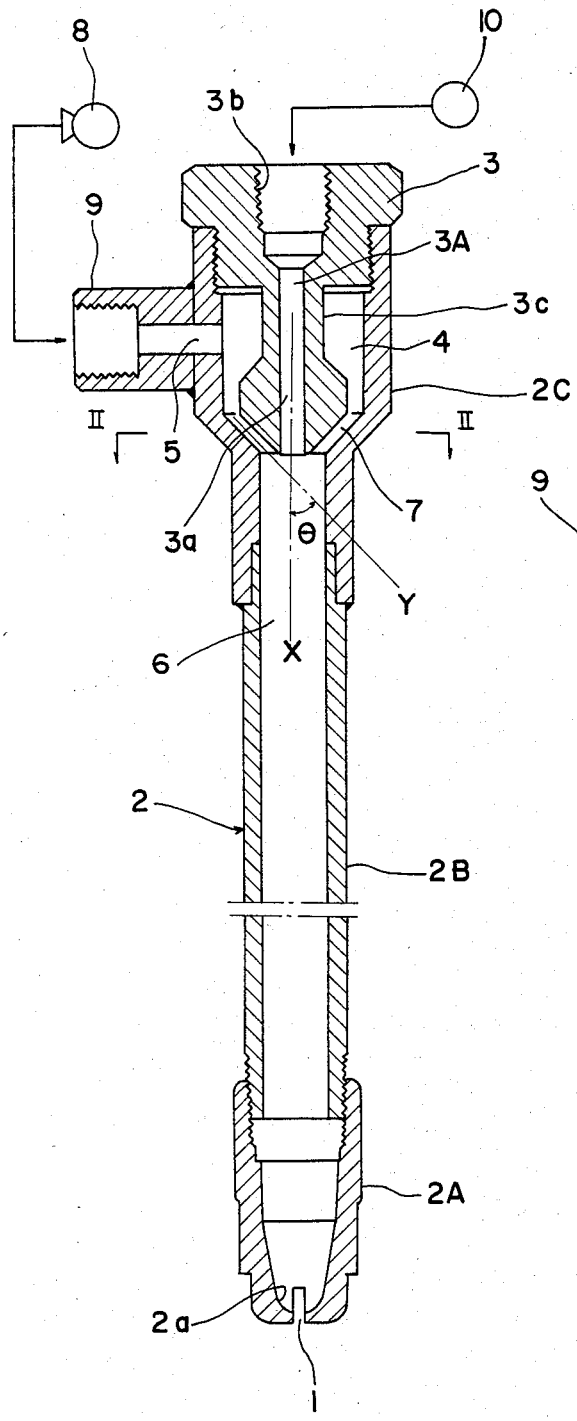
FIG. 1 is a front view in vertical section of a nozzle apparatus according to the present invention.
Figure 2:
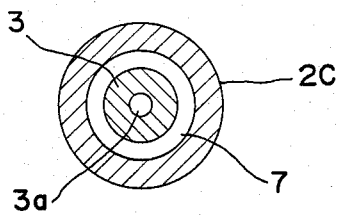

This invention is described referring to a nozzle apparatus used for spraying water by means of air in order to cool steel materials produced by a continuous casting system. As shown in FIGS. 1 and 2, a jet pipe 2 has an orifice 1 at a forward end thereof for spraying air mist, and contains a nozzle member 3 to be coaxial therewith for jetting out gas, or air, toward the orifice 1, the nozzle member 3 being rigidly in mesh with a base end of the jet pipe 2. The jet pipe 2 and the nozzle member 3 together define a chamber 4 providing an annular space which receives liquid, or water, from a port 5 defined in a portion of the jet pipe 2 opposed to a periphery of the nozzle member 3 defining an air jet passage 3A, that is to say, opposed to a portion of the nozzle member 3 lying inside the jet pipe 2. An inclined, annular, or more particularly a funnel-shaped, liquid outflow passage 7 is provided to extend from the chamber 4 to a mixing space 6 in the jet pipe 2. The outflow passage 7 has a cross-sectional area S2, about 35.4 $mm^2$, smaller than a cross-sectional area S1 of the chamber 4, about 374 $mm^2$. The outflow passage 7 guides and jets out water supplied to the chamber 4 toward an axis X extending from an injection mouth 3*a* of the air jet passage 3A to the orifice 1.

The outflow passage 7 has outflow directions, or axes of outflow Y crossing at a predetermined angle $\theta$ with a direction, or an axis of air jet X, in which air is jetted out of the nozzle member 3. Experiments show that the angle $\theta$ to the axis of air jet X is desirably between 35 degrees and 55 degrees. It has also been found out that a desirable ratio between the cross-sectional area S2 of the outflow passage 7 and the cross-sectional area S1 of the chamber 4 is $\frac{1}{3}$ to $\frac{1}{8}$.

The jet pipe 2 comprises a nozzle tip 2A defining the orifice 1, a tubular body 2B defining the mixing space 6, and a tubular casing 2C defining the water supply port 5 and a female screw for securely holding the nozzle member 3. The nozzle tip 2A is in rigid mesh with the tubular body 2B, and the tubular body 2B and the tubular casing 2C are rigidly welded to be coaxial with each other.

The water supply port 5 which is defined in a peripheral position of the casing 2C is securely fitted such as by welding with a metal connector 9 to connect the port 5 to a water supply means such as a pump 8.

The nozzle tip 2A has a curved inner peripheral wall surface 2*a* tapering toward the orifice 1.

The nozzle member 3 includes a female screw 3*b* to provide connection with a gas supply means such as a pump 10, and a peripheral recess 3*c* to form the annular chamber 4.

Figure 12:
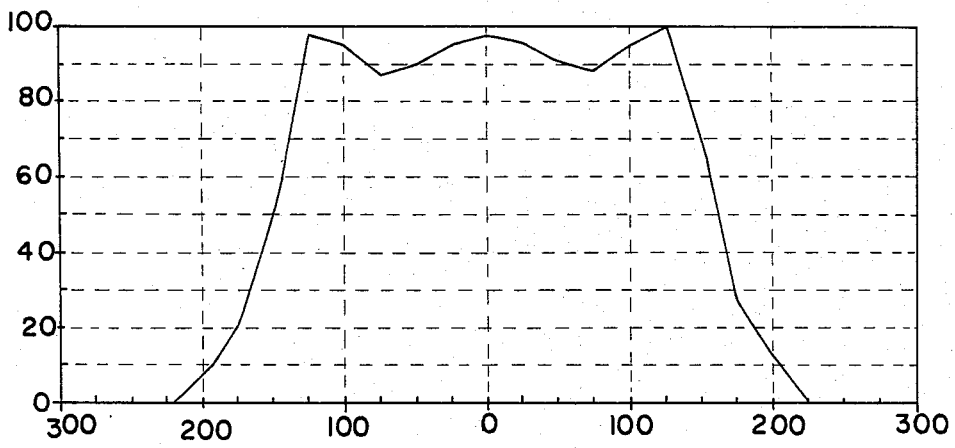
FIG. 12 is a graph showing divergence of liquid sprayed from the nozzle apparatus of this invention.
Figure 14:
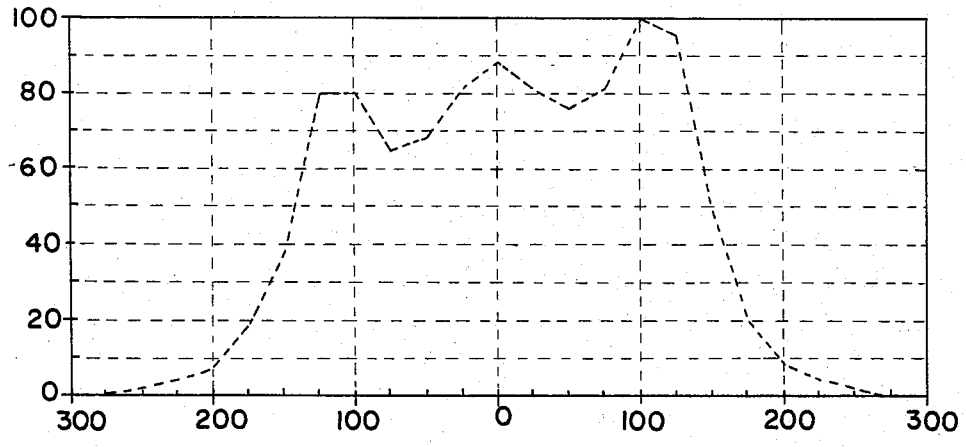
Fig 14 (Prior Art)
FIG. 14 is a graph showing divergence of liquid sprayed from the nozzle apparatus of FIG. 13.

FIG. 12 is a graph showing the results of tests carried out on the described nozzle apparatus in respect of its spray divergence, from which it is seen that the spray divergence is substantially symmetric about the nozzle tip 2A.

Figure 3:
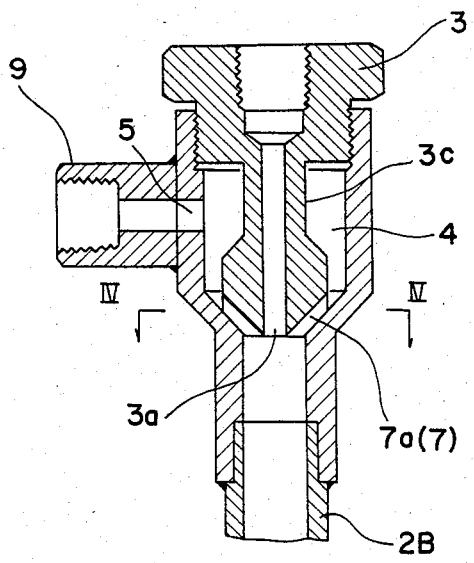
FIG. 3 is a front view in vertical section of a principal part.
Figure 4:
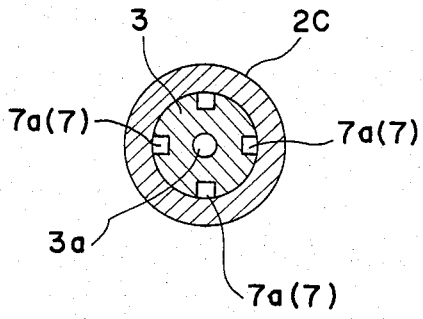
FIG. 4 is a sectional view taken on line IV—IV of FIG. 3.
Figure 5:
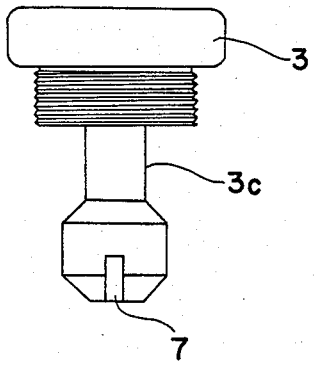
FIG. 5 is a front view of a modified nozzle member.

Referring to FIGS. 3 through 5 showing a modified nozzle apparatus, the inclined liquid passage 7 is here divided into four passage parts 7*a* displaced from one another by 90 degrees on the periphery of the nozzle member 3 and oriented toward the axis X.

Figure 8:
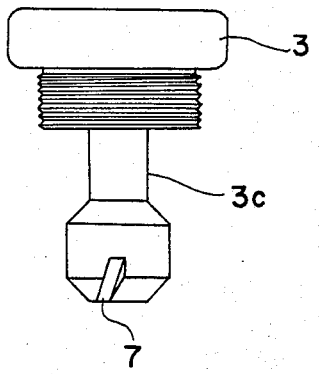
FIGS. 6 through 8 are front views each showing a further example of nozzle member.
Figure 6:
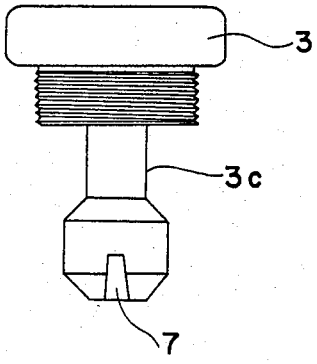
Figure 7:
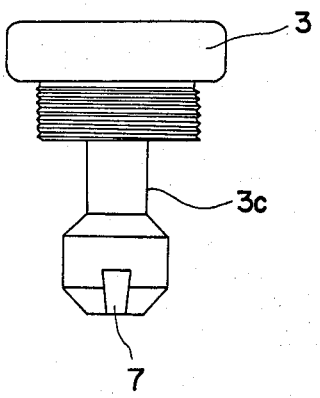

Each of the passage parts 7*a* may be flared downwardly so that its peripheral width increases progressively toward a downstream end as shown in FIG. 6, or may be narrowed downwardly from an upstream end to the downstream end as shown in FIG. 7. It is also possible to form each of the passage parts 7*a* inclined in a helical direction relative to the axis of the nozzle member 3 as shown in FIG. 8.

Figure 9A:
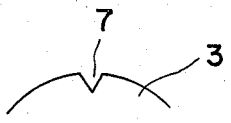
FIGS. 9*a*, 9*b* and 9*c* are sectional views each showing a different shape of outflow passage means.
Figure 9B:
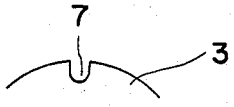
Figure 9C:
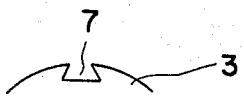

Furthermore, each of the passage parts 7*a* may have varied cross-sectional shapes besides a rectangular shape as seen in FIG. 4, such as a V-shape as in FIG. 9*a*, a U-shape as in FIG. 9*b*, and a dovetail shape as in FIG. 9*c*.

Figure 10:
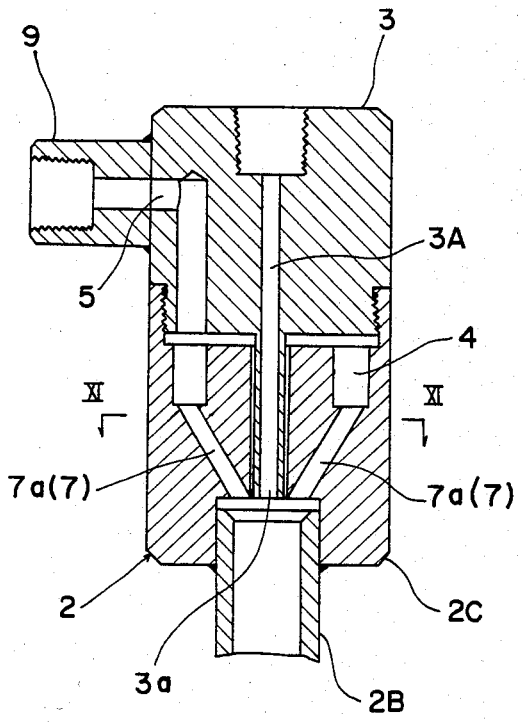
FIG. 10 is a front view in vertical section of a principal part of a further modification of the nozzle apparatus.
Figure 11:
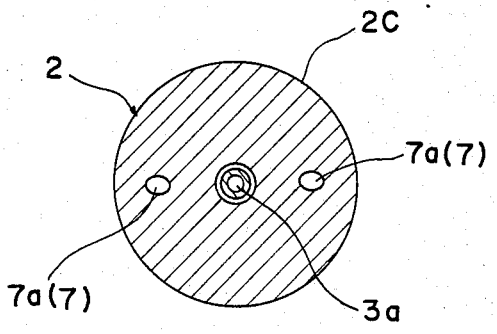
FIG. 11 is a sectional view taken on line XI—XI of FIG. 10.
Figure 13:
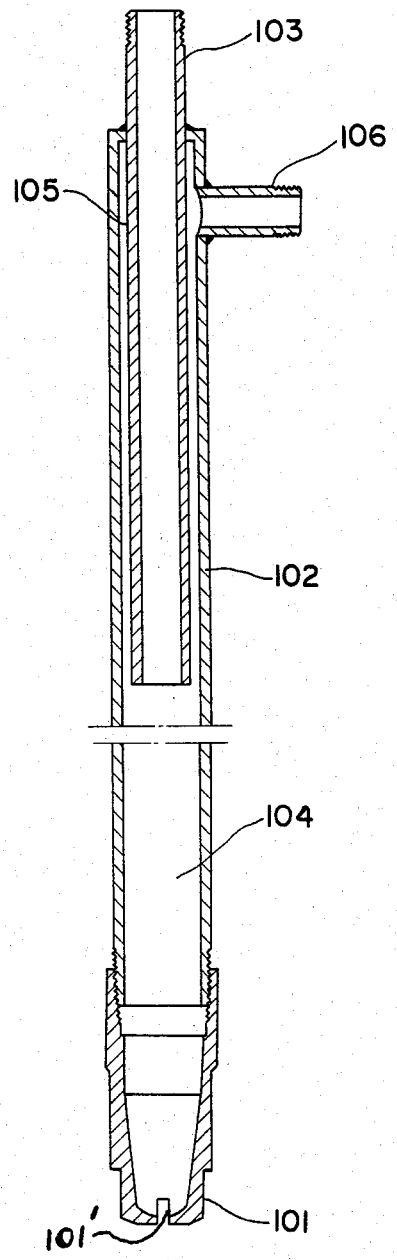
(Prior Art) Fig 13
FIG. 13 is a front view in vertical section of a known nozzle apparatus.

Referring to FIGS. 10 and 11 showing a further modified example of the nozzle apparatus, a tubular casing 2C which is a constituent element of the jet pipe 2 securely attached to the tubular body 2B defines an annular chamber 4 and two inclined liquid outflow passages 7*a* which are apart from each other by 180 degrees in the peripheral direction, while a nozzle member 3 includes an air jet passage 3A and a liquid supply port 5 to which a metal connector 9 is fitted.

In the foregoing embodiments and in the claims appended hereto, the invention is described as arranging air to be supplied from the nozzle member 3 and water to be supplied from the port 5. But this arrangement may be reversed without substantially departing from the object of the present invention although the degree of atomization may be slightly lowered.

I claim:

1. A nozzle apparatus for atomizing a liquid, said apparatus consisting of a jet pipe having a nozzle tip at one end thereof, a casing connected to the other end of said jet pipe, a liquid supply connector directly mounted in a sidewall of said casing and having a liquid supply port provided therethrough, and a nozzle member having a gas jet passage for injecting pressurized gas into a reduced diameter portion of said casing, wherein a recessed portion of said nozzle member and an enlarged diameter portion of said casing define a chamber for receiving a liquid in communication with said liquid supply port, and wherein a constricted middle portion of said casing defines a liquid outflow passage means around said nozzle in communication with said liquid receiving chamber, said liquid outflow passage means having liquid outflow directions crossing at a predetermined angle in relation to the flow of pressurized gas jetted out of said jet passage of said nozzle member into said reduced diameter casing portion.

2. A nozzle apparatus as claimed in claim 1 wherein said nozzle member (3) has a forward end thereof in contact with an inner wall of said casing (2C) and a base end thereof fixed to said casing (2C) to plug said chamber (4), said liquid outflow passage means (7) comprising a plurality of passage parts (7') defined in a peripheral wall of said forward end of said nozzle member (3).

3. A nozzle apparatus as claimed in claim 1 wherein said liquid outflow passage means (7) has outflow directions (Y) crossing at an angle ($\theta$) of 35 to 55 degrees with said direction (X) in which said gas is jetted out of said gas jet passage of said nozzle member (3).

4. A nozzle apparatus as claimed in claim 3 wherein a cross-sectional area (S2) of said liquid outlet passage means (7) and a cross-sectional area (S1) of said chamber (4) are in a ratio of $\frac{1}{3}$ to $\frac{1}{8}$.

* * * * *